US009736585B2

(12) United States Patent
Pattok

(10) Patent No.: US 9,736,585 B2
(45) Date of Patent: Aug. 15, 2017

(54) SYSTEM AND METHOD FOR DRIVING A LOW FREQUENCY SPEAKER

(71) Applicant: Gentex Corporation, Zeeland, MI (US)

(72) Inventor: Greg R. Pattok, Holland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 24 days.

(21) Appl. No.: 14/876,309

(22) Filed: Oct. 6, 2015

(65) Prior Publication Data

US 2016/0100252 A1 Apr. 7, 2016

Related U.S. Application Data

(60) Provisional application No. 62/060,857, filed on Oct. 7, 2014.

(51) Int. Cl.

| | |
|---|---|
| ***H04R 29/00*** | (2006.01) |
| ***H04R 3/00*** | (2006.01) |
| ***H04R 3/04*** | (2006.01) |
| ***G08B 3/10*** | (2006.01) |

(52) U.S. Cl.

CPC ..... *H04R 3/04* (2013.01); *G08B 3/10* (2013.01); *H04R 29/001* (2013.01)

(58) Field of Classification Search

CPC ..... H04R 3/00; H04R 3/002; H04R 3/007; H04R 3/04; H04R 3/08; H04R 29/001

See application file for complete search history.

(56) References Cited

U.S. PATENT DOCUMENTS

| | | | | |
|---|---|---|---|---|
| 5,226,089 | A * | 7/1993 | Yoon | H04R 3/04 381/59 |
| 6,339,368 | B1 * | 1/2002 | Leith | G08B 3/10 381/114 |
| RE43,461 | E * | 6/2012 | Hand | H03F 1/523 330/10 |
| 2005/0175195 | A1 * | 8/2005 | Cheney, Jr. | G01R 31/041 381/120 |
| 2011/0228945 | A1 * | 9/2011 | Mihelich | H04R 3/002 381/59 |
| 2015/0030167 | A1 * | 1/2015 | Pan | H04R 3/007 381/59 |
| 2015/0332584 | A1 * | 11/2015 | Tenkama | A61B 5/0205 340/516 |

* cited by examiner

*Primary Examiner* — Thang Tran

(74) *Attorney, Agent, or Firm* — Price Heneveld LLP; Bradley D. Johnson

(57) ABSTRACT

A control circuit configured to control a speaker is disclosed. The control circuit is configured to drive the speaker at a predetermined frequency that may correspond to a resonance frequency. The control circuit comprises a speaker driver in communication with a controller. The controller is operable to control a drive frequency of the speaker by monitoring at least a sample of each of a plurality of wavelengths of a current draw of the speaker in the form of a voltage signal. Based on the voltage signal, the controller is operable to identify a voltage differential and adjust the drive frequency of the speaker in response to the voltage differential to maintain the predetermined frequency.

15 Claims, 3 Drawing Sheets

SYSTEM AND METHOD FOR DRIVING A LOW FREQUENCY SPEAKER

CROSS REFERENCE TO RELATED APPLICATION

This application claims priority of U.S. Provisional Application No. 62/060,857, filed Oct. 7, 2014, and the entirety of which is incorporated by reference herein.

TECHNOLOGICAL FIELD

The disclosure relates to improved operation of a speaker.

BRIEF SUMMARY

According to one aspect of the present disclosure, a control circuit configured to control a speaker is disclosed. The control circuit is configured to drive the speaker at a predetermined frequency that may correspond to a resonance frequency. The control circuit comprises a speaker driver in communication with a controller. The controller is operable to control a drive frequency of the speaker by monitoring a sample of each of a plurality of wavelengths of a current draw of the speaker in the form of a voltage signal. Based on the voltage signal, the controller is operable to identify a voltage differential and adjust the drive frequency of the speaker in response to the voltage differential to maintain the predetermined frequency.

According to another aspect of the present disclosure, a method for controlling an operating frequency of a speaker is disclosed. The method comprises monitoring a current draw of the speaker and identifying a signal differential of the current draw. The method continues by adjusting a drive frequency of the speaker in response to the signal differential and maintaining the operating frequency. The operating frequency of the speaker is maintained at approximately a resonance frequency by adjusting the drive frequency.

According to yet another aspect of the present disclosure, a notification appliance is disclosed. The notification appliance comprises a speaker and a speaker driver configured to drive the speaker. The appliance further comprises a feedback circuit configured to monitor an operating frequency of the speaker and a controller in communication with the speaker driver and the feedback circuit. The controller is configured to monitor a current draw of the speaker via the feedback circuit and identify a signal differential of the current draw. The controller is further operable to adjust a drive frequency of the speaker in response to the signal differential and maintain the operating frequency to approximately a resonance frequency of the speaker by adjusting the drive frequency.

These and other features, advantages, and objects of the present disclosure will be further understood and appreciated by those skilled in the art by reference to the following specification, claims, and appended drawings.

DETAILED DESCRIPTION

Figure 1:
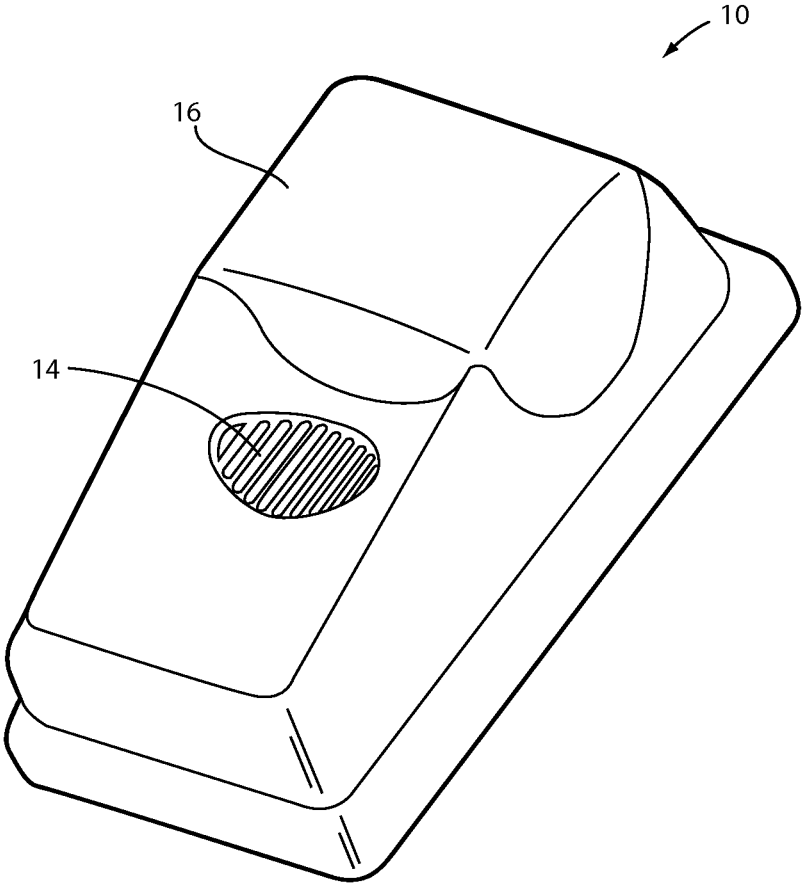
FIG. 1 is a perspective view of a notification apparatus.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
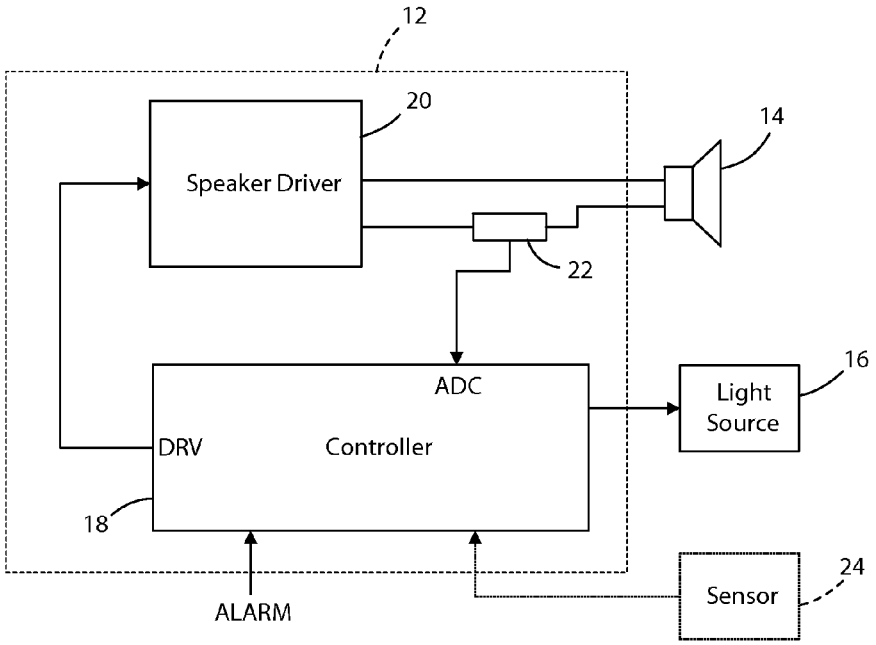
FIG. 2 is a diagram of speaker control circuit for a notification apparatus.

Referring to FIGS. 1 and 2, a perspective view of a notification apparatus 10 and block diagram of a control circuit 12 of the notification apparatus 10 are shown, respectively. The notification apparatus 10 may comprise a speaker 14 and a light source 16 in communication with the control circuit 12. The control circuit 12 is configured to control an output of an audible tone from the speaker 14 and may also selectively activate the light source 16 to output light. In some implementations, the notification apparatus 10 may serve as an alarm device configured to output the audible tone and light as a strobe emission to alert a person of an alarm condition.

The notification apparatus 10 may be designed to operate at a high level of efficiency while maintaining important performance characteristics that may be required to successfully alert a person of an alarm condition. The high level of efficiency may provide for cost savings by limiting power ratings of power supplies and extending battery life by decreasing power usage. Additionally, in emergency situations, power supplied by central utilities may be inoperable. By maintaining efficiency, the notification apparatus 10 provides for robust and extended operation from a power supply that may have a limited charge (e.g. a battery power supply).

For example, during an emergency an alarm condition may be detected by the notification apparatus 10 and/or received as an ALARM signal. In such a situation, the notification apparatus 10 may be required to output the audible tone at a target frequency and further output light at a predetermined intensity. In an exemplary implementation, the audible tone may be required to operate a target frequency of approximately 520 Hz±10%. In order to ensure that the notification apparatus 10 can maintain these performance characteristics while maintaining a current draw, it may be beneficial to operate the speaker 14 and the light source 16 as efficiently as possible.

To ensure efficient operation while maintaining an approximate target frequency of the speaker 14, the control circuit 12 is operable to adjust a driving frequency of the speaker 14. The speaker 14 may be configured to have a resonance frequency corresponding to the target frequency. By designing the speaker 14 to have a resonance frequency approximately equal to the target frequency, the notification apparatus 10 may output the audible tone at a peak level of efficiency. However, changes in environment, manufacturing defects, wear, damage, and a variety of other variables may cause variations in the audible tone such that the audible tone drifts and no longer corresponds to the resonance frequency. Under such circumstances, the speaker 14 may draw an increased amount of power from the control circuit 12 to operate the speaker 14. Consequently, the increased power usage of the speaker 14 may detrimentally affect the performance and efficiency of the notification apparatus 10.

In order to account for variables that may lead to inefficient operation, the control circuit 12 is configured to monitor the current draw of the speaker 14 and adjust the driving frequency to maintain efficient operation. The control circuit 12 comprises a controller 18, a speaker driver 20, and a measurement device 22. The controller 18 comprises a driver output DRV configured to output a drive frequency. The drive frequency is output from the driver output DRV to the speaker driver 20 at a predetermined drive frequency that may approximately correspond to the target frequency. In response receiving the predetermined drive frequency, the speaker driver 20 may output a current signal in approximately the form of a sinusoidal wave configured to oscillate at approximately the resonance frequency of the speaker 14.

In response to receiving the current signal from the speaker driver 20, the speaker 14 may output the audible tone. However, due to the variables discussed herein and various faults that may affect operation, the current signal may not accurately correspond to the resonance frequency of the speaker 14. In order to maintain the peak efficiency at the resonance frequency, the controller 18 is configured to monitor the current draw of the speaker 14 via the measurement device 22 and an analog input ADC. By monitoring the current draw of the speaker, the controller 18 is operable to determine if the speaker 14 is accurately being driven at the resonance frequency.

The measurement device 22 is configured to supply an analog voltage reading to the analog input ADC of the controller 18 that represents that current draw of the speaker 14. The analog input ADC of the controller 18 may comprise an analog to digital to converter operable to supply a digital value corresponding to the current draw of the speaker 14 to the controller 18. In this configuration, the controller 18 is operable to sample the current supplied to speaker 14 by sampling the digital value of the voltage signal received from the measurement device 22. By monitoring the current supplied to the speaker 14 via the analog input ADC, the controller 18 is operable to detect changes in the drive frequency and identify if the speaker 14 is operating at a frequency greater than or less than the resonance frequency.

In response to identifying that the operating frequency of the speaker 14 is greater than or less than the resonance frequency, the controller 18 is operable to adjust a control signal from the driver output DRV. The controller 18 increase or decrease the drive frequency from the predetermined drive frequency to an adjusted drive frequency to control the speaker 14 and maintain operation at, or approximate to resonance. The digital value received by the controller 18 at the analog input may correspond to a measurement of a portion of the current signal supplied to the speaker 14. In an exemplary implementation, the voltage signal and the corresponding ADC value may correspond to a lower or upper portion of the approximately sinusoidal current signal drawn by the speaker 14. In response to variations in the ADC value, the controller 18 is operable to increase and decrease the drive frequency supplied to the speaker driver 20 to ensure that efficient operation is maintained. Further description of the voltage signal and corresponding ADC value are discussed in reference to FIGS. 4A-4C.

As discussed herein, the notification apparatus 10 may be operable to detect an alarm condition. In such implementations, the notification apparatus 10 may comprise a sensor 24. The sensor 24 may correspond to any form of sensor configured to detect a condition related to an environment condition, a hazard, or a safety concern. In some implementations, the sensor 24 may correspond to at least one of a smoke detector, carbon monoxide sensor, carbon dioxide sensor, light sensor, and/or any of a variety of sensors configured to detect environmental conditions proximate the notification apparatus 10. As such, the notification apparatus 10 may be implemented independently and/or as a part of a notification system configured to emit an alert in response to the detection of an alarm condition.

Figure 3:
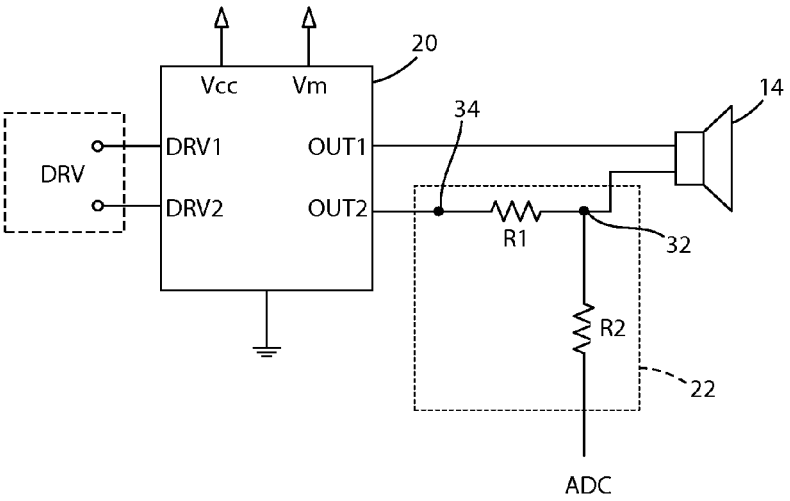
FIG. 3 is a schematic diagram of a speaker drive circuit operable to maintain a resonance frequency.

Referring now to FIG. 3, a schematic diagram of the speaker driver 20 and the measurement device 22 is shown. The driver output DRV of the controller may comprise a first drive signal and a second drive signal supplied to the speaker driver 20 to control the driving frequency supplied to the speaker 14. The speaker driver 20 comprises at least one voltage supply input Vcc configured to receive power to control the drive frequency logic. In some implementations, the speaker driver 20 may further comprise a motor power supply input Vm configured to receive a voltage to control the magnitude of the voltage for the driving current supplied to the speaker 14. The controller 18 and/or additional control circuitry in communication with the controller 18 may be operable to adjust the voltage supplied to the motor supply input Vm to provide a plurality of voltage levels to adjust the volume of the audible tone output from the speaker 14.

For example, the controller 18 may be operable to supply a first voltage to the motor supply input Vm to output the audible tone at a first volume level. The controller 18 may further be operable to supply a second voltage to the motor supply input Vm to output the audible tone at a second volume level. In some implementations, the voltage supplied to the motor supply input Vm may be approximately 3.8 V corresponding to the first volume level and approximately 5 V corresponding to the second volume level. Though particular voltages are discussed herein corresponding to the first volume level and the second volume level, the voltage supplied to the motor supply input Vm may correspond to a variety of voltage levels configured to operate a particular speaker.

In some implementations, the measurement device 22 is configured to convert the current drawn by the speaker 14 to a voltage signal that is monitored by the controller 18 via the analog input ADC. The measurement device 22 may be configured to operate as a voltage divider having a first resistor R1 and a second resistor R2. In this configuration, the voltage across the first resistor R1 may be measured by the controller 18 as a scaled voltage value over the second resistor R2. For example, the voltage at a first node 32 may be measured by the controller 18 via the analog input ADC through the second resistor R2. Additionally, the controller 18 may compare the voltage at the first node 32 to the voltage at a second node 34, which may correspond to a reference voltage.

The voltage received by the controller 18 via the resistor R2 may be converted to a digital signal by the analog to digital converter such that the controller 18 may sample voltage at the first node 32 to monitor the driving current drawn by the speaker 14. In this configuration, the controller 18 is operable to sample the current supplied to speaker 14 by sampling the digital value of the voltage signal received from the measurement device 22. By monitoring the current drawn by the speaker 14 via the analog input ADC, the controller 18 is operable to detect changes in the drive frequency and identify if the speaker 14 is operating at a frequency greater than or less than the resonance frequency.

Figure 4A:
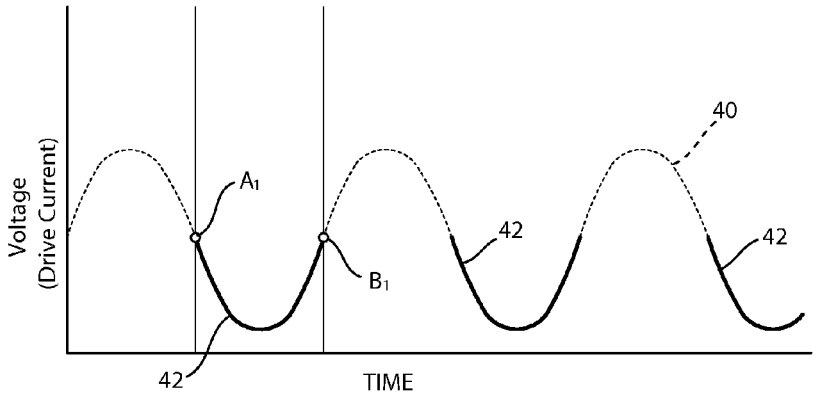
FIG. 4A is a graphical depiction of a current draw of a speaker operating at approximately a resonance frequency.
Figure 4B:
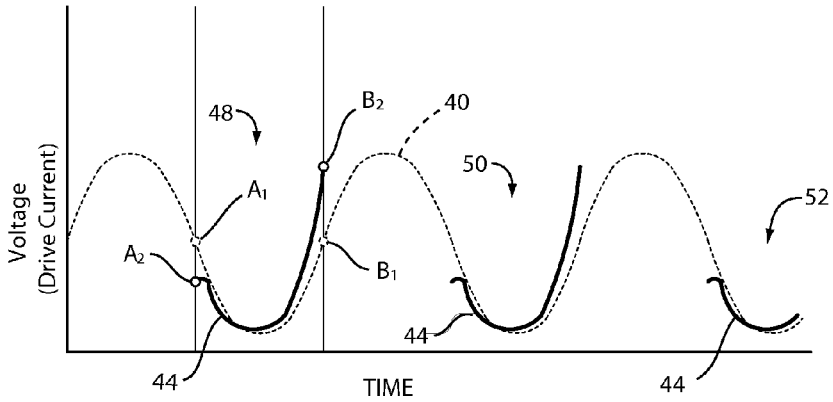
FIG. 4B is a graphical depiction of a current draw of a speaker operating at a frequency less than a resonance frequency.
Figure 4C:
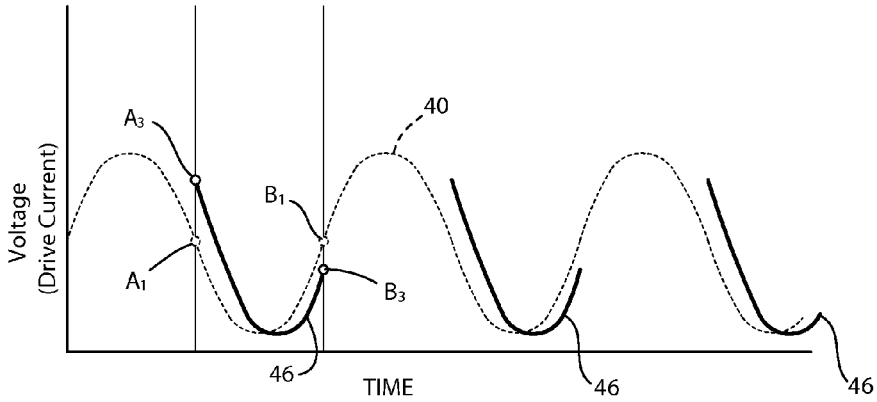
FIG. 4C is a graphical depiction of a current draw of a speaker operating at a frequency greater than a resonance frequency.

Referring now to FIGS. 4A-4C, the voltage signal received by the controller 18, corresponding to the driving current drawn by the speaker 14, is shown demonstrating signals corresponding to the speaker 14 operating at a resonance frequency, less than the resonance frequency, and greater than the resonance frequency, respectively. FIG. 4A demonstrates the voltage received from the measurement device 22 corresponding to the speaker 14 operating approximately at a resonance frequency 40. As described herein, the controller 18 may be operable to monitor the voltage corresponding to the driving current supplied to speaker 14 as a plurality of digital values represented by the first partial sinusoidal signal 42.

By monitoring the first partial sinusoidal signal 42, the controller 18 may identify a first voltage peak A1 and a second voltage peak B1. Once identified, the controller 18 may compare the first voltage peak A1 to the second voltage peak B1. If a voltage difference, or a digital value corresponding thereto, of the first voltage peak A1 and the second voltage peak B1 exceeds a predetermined threshold, the controller 18 may increase or decrease the drive frequency from the driver output DRV to the speaker driver 20 to adjust the driving frequency of the speaker 14. In this way, the controller 18 is operable to maintain the resonance frequency of the speaker 14.

FIG. 4B demonstrates the voltage received from the measurement device 22 corresponding to the speaker 14 operating at a frequency less than the resonance frequency. In this example, the controller 18 may compare a first voltage peak A2 and a second voltage peak B2 of a second partial sinusoidal signal 44. If the first voltage peak A2 is less than the second voltage peak B2, the controller 18 is configured to identify that the driving frequency supplied to the speaker 14 is less than the resonance frequency. In response to identifying that the driving frequency is less than the resonance frequency, the controller 18 may respond by increasing the drive frequency output from the driver output DRV. In this way, the controller 18 is operable to identify a condition corresponding to the driving frequency of the speaker 14 lagging behind the resonance frequency and incrementally adjust the driving frequency to ensure that efficient operation is maintained by operating the speaker 14 proximate the resonance frequency.

FIG. 4C demonstrates the voltage received from the measurement device 22 corresponding to the speaker 14 at a frequency greater than the resonance frequency. In this example, the controller 18 may compare a first voltage peak A3 and a second voltage peak B3 of a third partial sinusoidal signal 46. If the first voltage peak A3 is greater than the second voltage peak B3, the controller is configured to identify the driving frequency supplied to the speaker 14 is greater than the resonance frequency. In response to identifying that the driving frequency is greater than the resonance frequency, the controller 18 may respond by decreasing the drive frequency output from the driver output DRV. In this way the controller 18 is operable to identify condition corresponding to the driving frequency of the speaker 14 leading ahead of the resonance frequency and adjust the driving frequency proximate the resonance frequency.

A difference between the first voltage peak A and the second voltage peak B, corresponding to each of the voltage peaks (A1, A2, A3, B1, B2, B3), may be identified by the controller 18 in response to a voltage difference between the first voltage peak A and a second voltage peak B exceeding a difference threshold. The difference threshold may be a predetermined difference value corresponding to a difference in a first digital value corresponding to the first voltage peak and a second digital value corresponding to the second voltage peak. In response to the digital values corresponding to the first voltage peak A second voltage peak B exceeding the difference threshold, the controller 18 may adjust the drive frequency of driver output DRV to ensure that the driving current applied to the speaker 14 will approximately maintain the resonance frequency of the speaker 14.

In an exemplary implementation, the drive frequency output from the controller 18 may be adjusted over a plurality of cycles of the partial sinusoidal signal. For example, referring to FIG. 4B, the controller 18 may identify that the driving frequency of the speaker 14 is less than the resonance frequency at a first cycle 48. The controller 18 may then wait a plurality of cycles, for example a second cycle 50 and a third cycle 52, prior to adjusting the drive frequency output from the driver output DRV. As such, frequency or delay in the adjustment of the drive frequency may vary based on a desired system response.

For example, in some implementations the rate of adjustment may correspond to 2-6 cycles of the partial sinusoidal signal, and in an exemplary implementation may correspond to 4 cycles. By adjusting and updating the drive frequency output from the controller 18 after a plurality of cycles has been monitored, the controller 18 may accurately adjust the drive frequency to approximately align with the resonance frequency of the speaker 14. Adjusting the frequency or delay of the adjustment of the drive frequency may limit unwanted effects, such as wavering and/or dissonance in the audible tone due to over-correction.

The designations of the first partial sinusoidal signal 42, the second partial sinusoidal signal 44, and the third partial sinusoidal signal 46 are utilized herein for clarity. It may be understood that the numeric identifiers corresponding to the partial sinusoidal signals are utilized to discuss the signals in relation to a resonance frequency of the speaker 14. It shall be understood that these designations, as well as others utilized similarly herein, are not intended to limit the scope of the disclosure. Additionally it shall be understood that similar methods of control may be implemented by monitoring a full sinusoidal signal and/or sampling various portions of a signal to monitor the current drawn by the speaker 14.

The various implementations described herein may provide for a notification apparatus operable to maintain efficient operation by controlling a current drawn by a speaker. By monitoring the current drawn by the speaker, the notification apparatus may detect that the driving frequency of the speaker is leading ahead of or lagging behind a resonance frequency of the speaker. Upon identifying the leading or lagging condition of the driving frequency of the speaker, the controller of the notification apparatus may adjust an output drive frequency to ensure that the speaker may maintain an output of an audible tone at approximately the resonance frequency of the speaker.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A control circuit for a speaker configured to have a predetermined resonance frequency, the control circuit comprising:

a speaker driver;

a controller in communication with the speaker driver, the controller operable to control a drive frequency of the speaker, wherein the controller is configured to:

monitor at least a sample of a current draw of the speaker in the form of a voltage signal;

identify a voltage differential of the voltage signal; and adjust the drive frequency of the speaker in response to the voltage differential to maintain the resonance frequency;

wherein:

the voltage differential is identified by comparing a first voltage level of the voltage signal to a second voltage level of the voltage signal;

the first voltage level occurs at a first time and the second voltage level occurs at a second time; and the first time precedes the second time.

2. The control circuit according to claim 1, wherein the controller is further operable to adjust the drive frequency in response to the difference between the first voltage level and the second voltage level being greater than a predetermined threshold.

3. The control circuit according to claim 1, wherein the controller is further operable to increase the drive frequency in response to the first voltage level being less than the second voltage level.

4. The control circuit according to claim 1, wherein the controller is further operable to decrease the drive frequency in response to the first voltage level being greater than the second voltage level.

5. The control circuit according to claim 1, wherein the controller comprises an analog to digital converter configured to monitor the voltage level of the voltage signal.

6. A method for controlling an operating frequency of a speaker comprising the steps of:

monitoring a current draw of the speaker;

identifying a signal differential of the current draw;

adjusting a drive frequency of the speaker in response to the signal differential; and maintaining the operating frequency to approximately a resonance frequency by adjusting the drive frequency, wherein the current draw is monitored in the form of a voltage signal and the signal differential is identified by comparing a first portion of the voltage signal occurring at a first time to a second portion of the voltage signal occurring at a second time.

7. The method according to claim 6, wherein the voltage signal corresponds to a partial sinusoidal signal.

8. The method according to claim 6, wherein the voltage signal corresponds to approximately one-half of a sinusoidal signal.

9. The method according to claim 7, wherein the first time corresponds to an initial magnitude of the partial sinusoidal signal and the second time correspond to a final magnitude of the partial sinusoidal signal.

10. The method according to claim 6, further comprising:

identifying the resonant frequency by comparing a first magnitude of the first portion to a second magnitude of the second portion.

11. A notification appliance comprising:

a speaker;

a speaker driver configured to drive the speaker;

a feedback circuit configured to monitor an operating frequency of the speaker; and a controller in communication with the speaker driver and the feedback circuit, the controller being configured to:

monitor a current draw of the speaker via the feedback circuit;

identify a signal differential of the current draw;

adjust a drive frequency of the speaker in response to the signal differential; and maintain the operating frequency to approximately a resonance frequency of the speaker by adjusting the drive frequency, wherein the signal differential corresponds to a difference between an initial magnitude and a final magnitude of a signal formed by the current draw.

12. The notification appliance according to claim 11, wherein the signal corresponds to a partial sinusoidal signal.

13. The notification appliance according to claim 11, wherein the feedback circuit corresponds to a measurement device comprising a voltage divider.

14. The notification appliance according to claim 13, wherein the controller comprises an analog to digital converter configured to monitor a voltage of the voltage divider.

15. The notification appliance according to claim 11, further comprising a light source configured to form a notification signal.

* * * * *